US008447051B2

(12) United States Patent
Emilsson

(10) Patent No.: US 8,447,051 B2
(45) Date of Patent: May 21, 2013

(54) COMMUNICATION HEADSET

(75) Inventor: Niklas D. B. Emilsson, Rydaholm (SE)

(73) Assignee: 3M Innovative Properties Company, St. Paul, MN (US)

( * ) Notice: Subject to any disclaimer, the term of this patent is extended or adjusted under 35 U.S.C. 154(b) by 42 days.

(21) Appl. No.: 13/267,109

(22) Filed: Oct. 6, 2011

(65) Prior Publication Data

US 2012/0087519 A1 Apr. 12, 2012

(30) Foreign Application Priority Data

Oct. 11, 2010 (GB) ..... 1017105.6

(51) Int. Cl.
*H04R 25/00* (2006.01)

(52) U.S. Cl.
USPC ..... 381/151; 381/380; 381/370

(58) Field of Classification Search
USPC ..... 381/151, 370–371, 374–376, 380, 381/326
See application file for complete search history.

(56) References Cited

U.S. PATENT DOCUMENTS

| | | | | |
|---|---|---|---|---|
| 2,858,376 | A * | 10/1958 | Lewis | 381/326 |
| 4,712,244 | A * | 12/1987 | Zwicker et al. | 381/327 |
| 4,904,078 | A * | 2/1990 | Gorike | 381/327 |
| 6,456,721 | B1 | 9/2002 | Fukuda | |
| 6,999,732 | B2 | 2/2006 | Fukuda et al. | |
| 7,010,139 | B1 | 3/2006 | Smeehuyzen | |
| 7,076,077 | B2 | 7/2006 | Atsumi et al. | |
| 7,221,966 | B2 | 5/2007 | Birli et al. | |
| 2004/0136543 | A1 | 7/2004 | White | |
| 2008/0008344 | A1 | 1/2008 | Wakabayashi et al. | |
| 2009/0185699 | A1 | 7/2009 | Kim | |
| 2009/0304210 | A1 | 12/2009 | Weisman | |

FOREIGN PATENT DOCUMENTS

| | | | |
|---|---|---|---|
| WO | WO 03/055270 | A1 | 7/2003 |
| WO | WO 2005/091670 | A1 | 9/2005 |
| WO | WO 2009/101622 | A2 | 8/2009 |

OTHER PUBLICATIONS

Search Report for International Application No. PCT/US2011/055019 dated Mar. 27, 2012.
Search Report for Great Britain Application No. GB1017105.6 dated Feb. 10, 2011.

* cited by examiner

*Primary Examiner* — Suhan Ni
(74) *Attorney, Agent, or Firm* — Eric D. Levinson

(57) ABSTRACT

A communication headset is disclosed. The headset comprises two earpieces: a first earpiece, having a first arm, positionable in front of a wearer's ear and a second arm, positionable behind a wearer's ear, with a first bone conduction speaker carried on the second arm; and a second earpiece, having a first arm, positionable in front of a wearer's ear and a second arm, positionable behind a wearer's other ear, with a second bone conduction speaker carried on the second arm. A first microphone is carried on the first earpiece, and is adapted to detect ambient sound from at least a first direction. A second microphone is carried on the second earpiece, and is adapted to detect ambient sound from at least a second direction.

12 Claims, 3 Drawing Sheets

COMMUNICATION HEADSET

This application claims priority from Great Britain Serial No. 1017105.6, filed Oct. 11, 2010.

BACKGROUND

The present invention relates to a communication headset, in particular, a headset having first and second earpieces.

Communication headsets employing first and second ear cups linked together by an adjustable headband are used commonly in situations where there is a high level of noise. Such headsets offer both hearing protection and a communication function, enabling the wearer to communicate with a remote location regardless of local noise. Typically the ear cups are generally hemispherical and lined with a sound absorbing foam material. A seal is provided to contact the head of the wearer around the ears, providing good quality sound insulation.

A communication function can be realised as either a one-way or a two-way communication system. For example, an antenna can be mounted on the headset enabling signals to be transmitted to and from a wearer. Signals can be optionally processed by a processor mounted on the headset and relayed to speakers positioned within each ear cup, creating an audible sound within the sealed region around the ear. A microphone, such as a boom microphone, can also be mounted on the headset, and positionable to pick up speech from the wearer that is subsequently transmitted to a remote location via the antenna.

As wearing good quality hearing protection effectively damps out virtually all local noise, the wearer is isolated from their surroundings. Often ambient sounds (sound components within the local noise that are useful to the listener) are used subconsciously to aid positioning, for example, as both the direction and volume of a sound source gives valuable information to a listener. This is also an issue if there is a need to be able to hear sounds such as certain voices even though most frequencies are not required. One way of dealing with this is to provide a microphone mounted on each ear cup that detects ambient sound, which can then be transmitted to the wearer at a comfortable volume. Providing a microphone on each ear leads to the ability to distinguish the direction of noise using a stereo effect.

One example of a communication headset employing ambient sound detection is described in WO99/12385. The headset comprises a first ear cup, a second ear cup and a stirrup or headband interconnecting the ear cups. A microphone is provided for receiving ambient sound and an electronic control unit, actuable by means of a button set, is provided for transmitting sound from the microphone and a radio unit via speakers located in each ear cup.

SUMMARY

It is believed that the arrangement described above could potentially provide hearing protection, communication and awareness of ambient sound. This is typically done by utilising a cup that covers the ear of the wearer completely. In hot and humid conditions lightweight headsets are often preferred, as they offer cooling to the ear as well as effective sound insulation. An alternative to this is to provide an earplug with an internal speaker, as this also allows some cooling to the ear and surrounding region. However, it is desirable to be able to find a way to ensure that the communication headset can be worn even more comfortably during a wider range of conditions, with less dependence on ambient temperature or weather conditions, in a manner that is even more convenient to the wearer than with products currently available.

The present invention aims to address these problems by providing a communication headset, comprising: a first earpiece, having a first arm, positionable in front of a wearer's ear and a second arm, positionable behind a wearer's ear, with a first bone conduction speaker carried on the second arm; a second earpiece, having a first arm, positionable in front of a wearer's ear and a second arm, positionable behind a wearer's other ear, with a second bone conduction speaker carried on the second arm; a first microphone, carried on the first earpiece, adapted to detect ambient sound from at least a first direction; and a second microphone, carried on the second earpiece, adapted to detect ambient sound from at least a second direction.

By using microphones and bone conductive speakers to detect ambient sound positioned on an earpiece designed to fit around a wearers' ear, any difficulties perceived by the wearer in hot and humid conditions are reduced. Furthermore as there is no in-ear speaker component there is less restriction on the wearer's range of movement.

The first bone conduction speaker is preferably configured to relay a signal based on the ambient sound from the first direction, and the second bone conduction speaker is preferably configured to relay a signal based on the ambient sound from the second direction.

The first and second arms of the first and second earpieces are preferably linked together by a bridging portion located at a first end of each of the first and second arms. The bridging portion may carry a power supply for the microphone and/or the bone conduction speaker.

A communication means having a receiving means for receiving an input communication signal from a remote source may be provided. The first and second bone conduction speakers may be adapted to relay the input communication signal to a wearer.

Preferably one of the earpieces further comprises a bone-conduction microphone. In this situation, the communication means may comprise a transmitter for transmitting an output communication signal to a remote receiver, the signal being based on input to the bone conduction microphone.

Preferably there is a housing covering each earpiece. At least one control switch may be provided on the housing. The headset may also comprise an earplug connected to each earpiece by a flexible connector. The first and second earpieces may be joined together by a head band. Preferably, each earpiece further comprises at least one lug connectable with a headband, and a headband connected therebetween.

The invention also provides a method of relaying ambient sound to the wearer of a headset, comprising: detecting ambient sound from a first direction; detecting ambient sound from a second direction; relaying a signal based on the ambient sound from the first direction to a bone conduction speaker positioned behind an ear of a wearer; and relaying a signal based on the ambient sound from the second direction to a bone conduction speaker positioned behind the other ear of a wearer.

BRIEF DESCRIPTION OF THE DRAWINGS

The present invention will now be described by way of example only, and with reference to the accompanying drawings, in which.

DETAILED DESCRIPTION

The present invention has adopted the approach that it is not necessary to cover the ear completely to provide good quality hearing protection in conjunction with a communication function. An alternative form of hearing protection and sound transmission can be successfully combined in the form of an ear plug and bone conduction sound transmission technology to create a more comfortable and wearer-friendly communication headset. By removing the need for ear cups covering the ears of a wearer, a lightweight ear piece can be used to carry bone conduction devices, and as a base to which a freely movable ear plug can be fixed, if desired.

Figure 1:
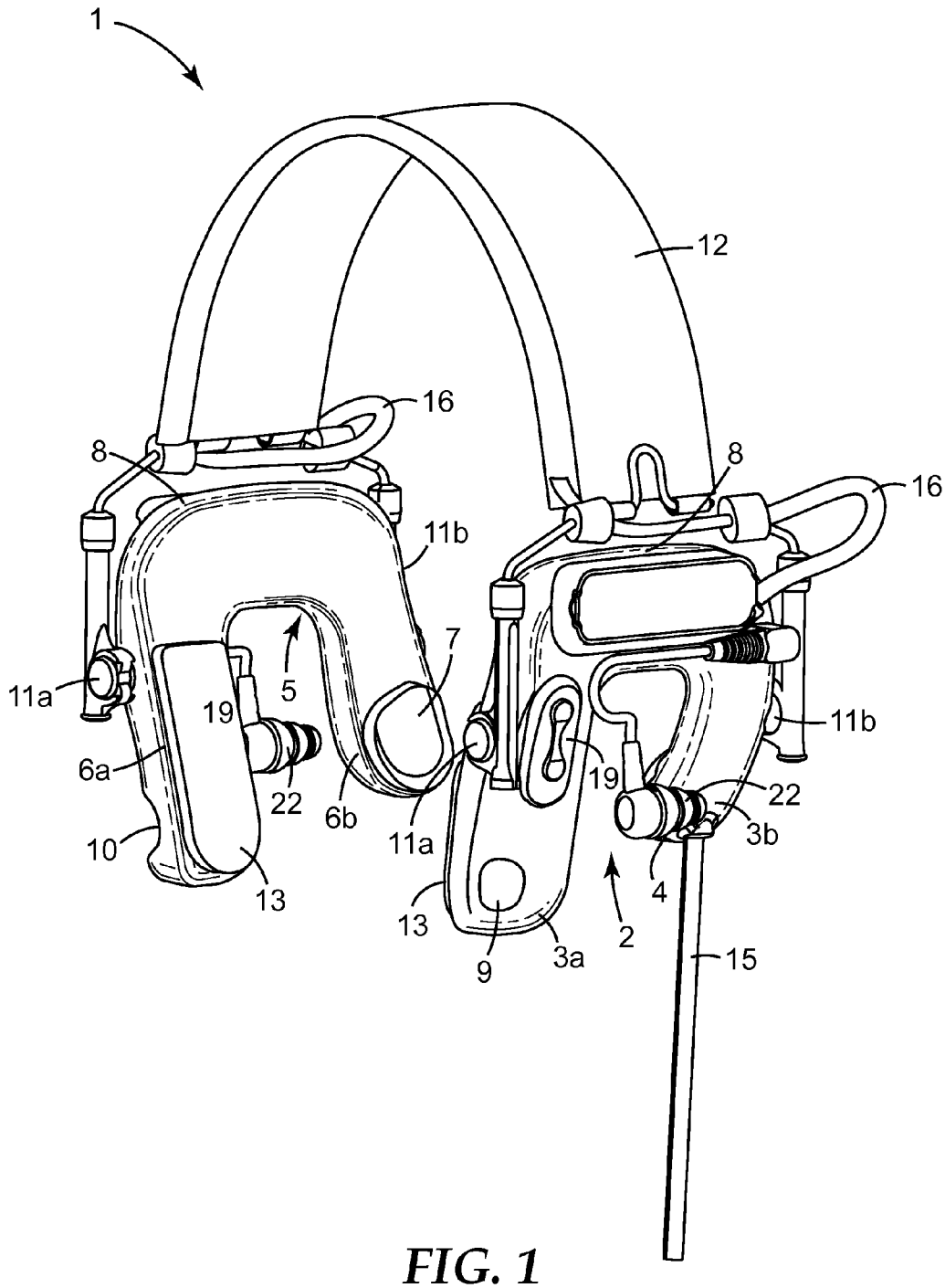
FIG. 1 is a perspective view of an embodiment headset in accordance with the present invention.
Figure 2:
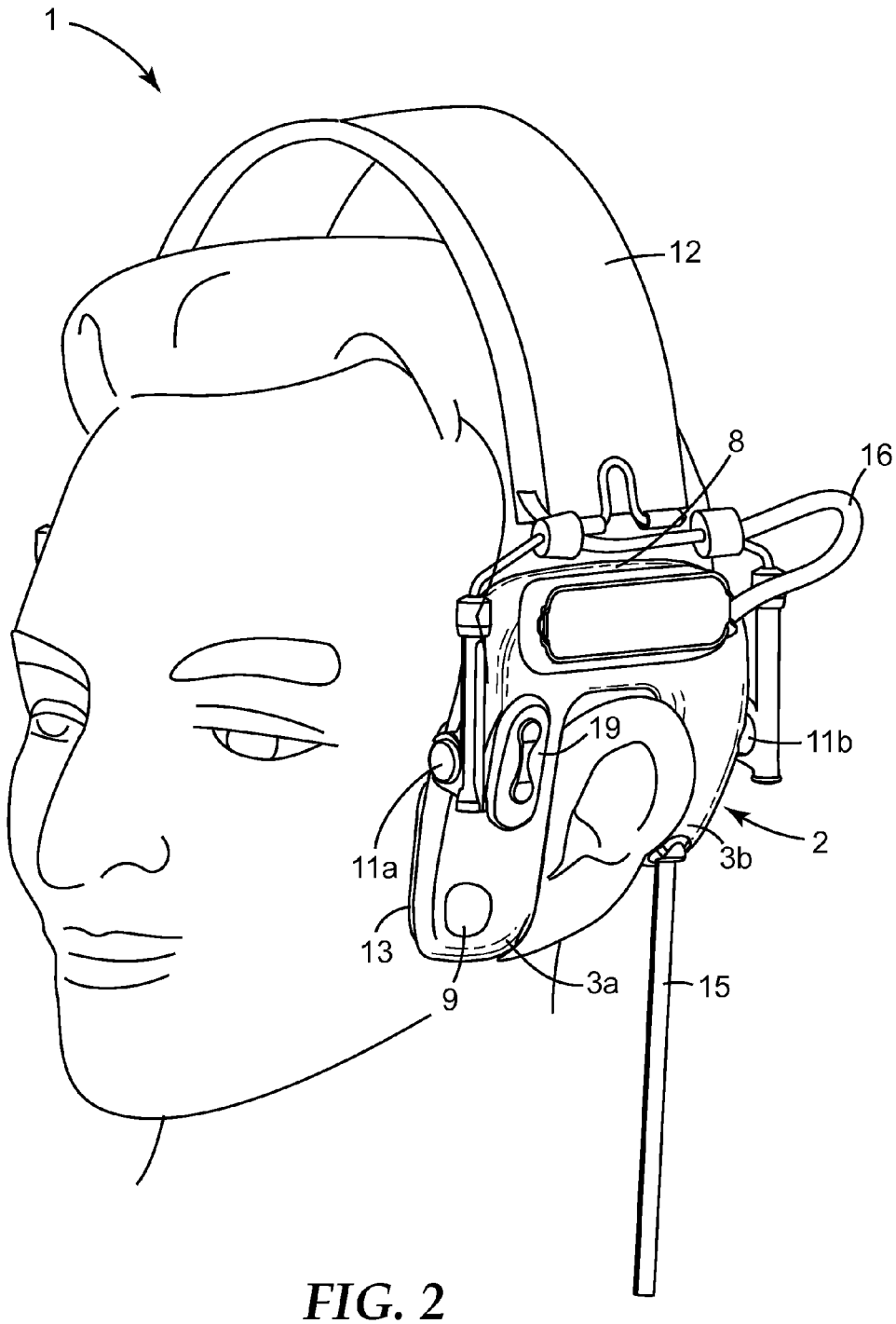
FIG. 2 is a perspective view of the headset shown in FIG. 1 positioned on the head of a wearer.

FIG. 1 is a perspective view of an embodiment of a headset in accordance with the present invention, and FIG. 2 is a perspective view of the headset shown in FIG. 1 positioned on the head of a wearer. However, the earplug shown in FIG. 1 is omitted from FIG. 2 to enable the fit of the earpiece around a wearers' ear to be shown more clearly. FIG. 2 illustrates how the portions of the earpieces of the headset fit around the ears of a wearer, as described in more detail below. References in the following description to "in front" of a wearers' ear indicate a portion of the earpiece lying closest to the face of the wearer, and to "behind" a wearers' ear indicate a portion of the headset lying furthest away from the face and closest to the back of the head of the wearer.

The headset 1 comprises a first earpiece 2, having a first arm 3*a*, positionable in front of a wearer's ear (not shown) and a second arm 3*b*, positionable behind a wearer's ear, with a first bone conduction speaker 4 carried on the second arm 3*b*. A second earpiece 5, again having a first arm 6*a*, positionable in front of a wearer's ear and a second arm 6*b*, positionable behind a wearer's other ear is also provided. A second bone conduction speaker 7 carried on the second arm 6*b* of the second earpiece 5. Each of the first 3*a*, 6*a* and second 3*b*, 6*b* arms is linked together by a bridging portion 8 located at a first end of each of the first 3*a*, 6*a* and second 3*b*, 6*b* arms, a second end of each of the first 3*a*, 6*a* and second 3*b*, 6*b* arms being free or unattached. In the embodiment shown, this creates a substantially inverted capital "U" shaped earpiece 2, 5 that fits around the ear of a wearer. The overall size of the earpiece illustrated is approximately 100 mm×100 mm with a thickness of 25 mm. In addition to the first 3*a*, 6*a* arms lying in front of a wearer's ears, and the second 3*b*, 6*b* arms lying behind a wearer's ears when worn, the bridging portion is positionable above the wearer's ears. Each earpiece 2, 5 is a two-piece construction, comprising a base portion and a housing, as shown in more detail in FIGS. 3 and 4 below. The bone conduction speakers 4, 7 enable sound to be transmitted to the wearer, as the first arms 3*a*, 6*a* are positionable such that the bone conduction speakers 4, 7 can be in close contact with the skin of the wearer and thus transmit sound via the wearer's skull bones. The bone conduction speakers 4, 7 are adapted to relay an input communication signal to a wearer, where the input communication signal is received from a remote source.

In order to provide an ambient sound detection function, microphones are carried on each of the earpieces 2, 5. A first microphone 9 is carried on the first earpiece 2, and is adapted to detect ambient sound from at least a first direction. The first microphone 9 is mounted within a hollow provided in the housing on the first arm 3*a*, such that it lies in front of a wearer's ear in use. A second microphone 10 is carried on the second earpiece 5, and is adapted to detect ambient sound from at least a second direction. The second microphone 10 is mounted within a hollow provided in the housing on the first arm 6*a*, such that it lies in front of a wearers' ear in use. The first bone conduction speaker 4 is configured to relay a signal based on the ambient sound from the first direction, and the second bone conduction speaker 7 is configured to relay a signal based on the ambient sound from the second direction, so as to create a stereo effect. Each microphone is positioned so as to be able to detect sound from the greatest range of directions and covers an approximate hemisphere centred on the wearer's head and spreading out around the ear. Initially ambient sound is picked up by at least one microphone 9, 10. The first and second directions represent sounds heard in a hemisphere centred around the ear adjacent the first earpiece 2 and in a hemisphere centred around the ear adjacent the second earpiece 5, respectively. Consequently the first and second directions are different and correspond to opposite sides of the wearers' head. The signals generated by each microphone 9, 10 are sent to a circuit board, located within the first earpiece 2, as described in more detail below. This provides gain and volume control, processing the signal to an acceptable volume and filtering out or enhancing certain frequencies as required. The processed signal is then fed to the bone conduction speakers 4, 7 and relayed at an appropriate intensity to enable the wearer to have a full awareness of their surroundings.

Each earpiece 2, 5 is provided with at least one lug 11*a*, 11*b*, and two in the example shown, connectable with a headband 12. FIG. 1 shows a headband 12 connected therebetween, the headband 12 being adjustable so as to form a comfortable fit for the wearer. The lugs 11*a*, 11*b* are substantially cylindrical in shape, with the axes of each cylinder aligned with an axis running along the length of the bridging portion 8.

Figure 3:
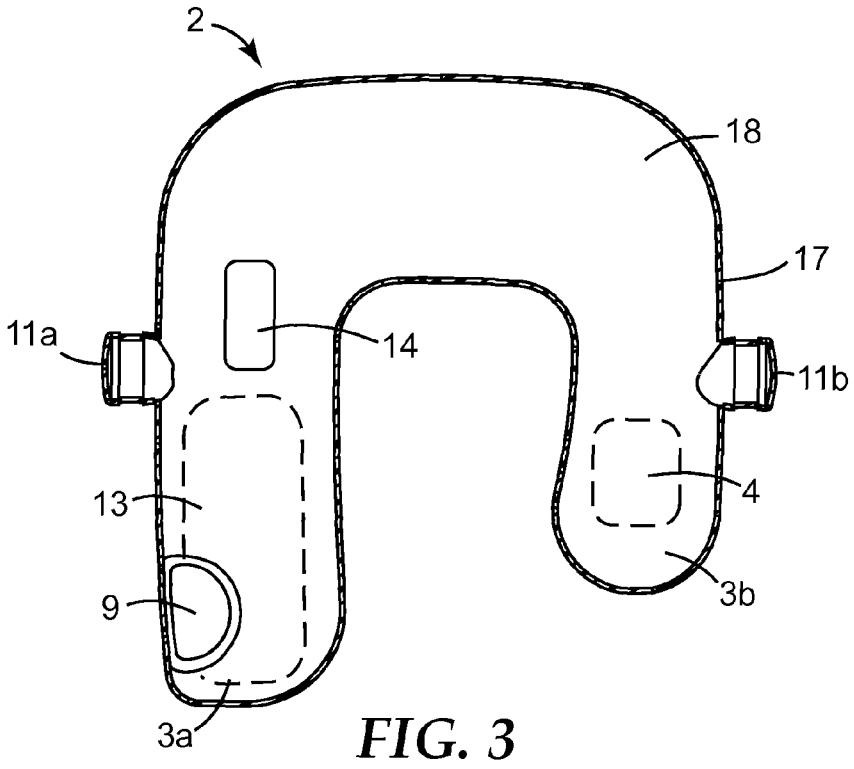
FIG. 3 is a side view of the outward facing surface of one of the earpieces shown in FIGS. 1 and 2, with the housing removed.

FIG. 3 is a side view of the outward facing surface of one of the earpieces shown in FIGS. 1 and 2, with the housing removed. Although each earpiece is in essence a mirror image of the other earpiece, one, for example, that worn on the left ear, is additionally provided with a bone conduction microphone. This earpiece is illustrated in FIG. 3. The other earpiece 5, for example, that worn on the right ear is provided with all of the features discussed below, except for the bone conduction microphone, circuit board and cable. The positioning of the bone conduction microphone on the earpiece 2 worn on the left ear is desirable to reflect that a majority of wearers will be right-handed, and therefore the bone conduction microphone is more conveniently worn on the left side of the face. However, for a left-handed wearer the earpieces 2, 5 would be provided in a mirror configuration, with the bone conduction microphone worn on the right hand side of the face.

The earpiece 2 is, as described above, substantially in the shape of an inverted capital letter "U". The first arm 3*a* carries not only the first microphone 9, but a bone conduction microphone 13 positioned so as to pick up vibrations through the jaw bone when the wearer of the headset 1 is speaking. The bone conduction microphone used was the BU-3173, available from Knowles Electronics, 1151 Maplewood Drive, Itasca, Ill., 60143, USA, and the microphones used to detect ambient sound were WM-034D M available from Panasonic Corporation, 1006, Oaza Kadoma, Kadoma-shi, Osaka 571-8501, Japan. The first arm 3*a* also carries a circuit board 14 on which is mounted the circuitry required to form a communication means adapted to receive an input communication signal from a remote source (a receiver unit). This can be described by two channels, each having a microphone amplifier and equaliser, a volume control, ability to sum the signals received and process, a gain control and an output to the bone conduction speakers 4, 7. The signal is then processed and relayed to the bone conduction speakers along with any signal derived from ambient sound, as described below. Suitable bone conduction speakers are available as the FX-3955-000 from Knowles Electronics, as above.

The bridging portion 8 carries a power supply. This is used for the first microphone and/or the first bone conduction speaker and/or the circuit board 14, if provided, comprising an "AAA"-sized battery (not shown, having a voltage of 1.2V or 1.5V depending on the type used) positioned along the length of the bridging portion. Carrying the weight of the battery above the ear is more comfortable for the wearer, as the centre of mass of the earpiece 2 is close to the centre of the bridging portion 8, and hence there is no feeling of unwanted weight offset from the ear when the wearer moves their head.

The second arm 3*b* carries the bone conduction speaker 4, which is adapted to relay the input communication signal to a wearer. To do so, the bone conduction speaker 4 needs to be in close contact with the skin of the wearer, so that the vibrations from the bone conduction speaker are transmitted accurately and at an appropriate intensity for the wearer to be fully aware of the contents of the communication signal and have an awareness of their surrounds from the signal processed from the input of the first microphone positioned on the first arm 3*a*. The amount of pressure required to hold the bone conduction speaker 4 against the skin of the wearer needs to be sufficient to prevent the sound dampening effect of the skin from having a detrimental effect on the signals received by the wearer. To do this, the adjustable headband 12 is formed from a material having a spring-like behaviour, for example, two metal wires forming a frame with band of plastic or leather material stretched between them. The wires are bent in a generally circular shape to an extent that the gap between the ends of each wire is smaller than the distance between the ears of a wearer. This means that the wires must be bent out of shape for the headband and earpieces to be fitted over the head, but the wires then spring back to as close to their original shape as possible, holding the earpieces tightly against the wearer's head. A cable 15 is provided on the second arm 3*b* to transmit signals to and from the headset 1 via a remote device, such as a two-way radio (not shown). The cable 15 is connected directly into the circuit board 14. Typically the cable used is a five strand copper-alloy wire in an insulating sheath, although shielding may also be provided if desired. A cable 16 connects the first 2 and second 5 earpieces, by being carried by the headband 12 between the two. Typically the cable used is a nine strand copper alloy wire, again in an insulating sheath with shielding provided if required. Ambient sound detected by the second microphone 10 is transmitted to the circuit board 14 via the cable 15, so that circuitry provided on the circuit board 14 is adapted to process signals for transmission to the second earpiece 5 based on ambient sound detected by both the first 9 and second 10 microphones. Consequently signals based on the ambient sound detected by the second microphone and signals received from a remote source and processed by the circuitry of the circuit board can be transmitted to the second earpiece 5 by the cable 16. The cable is also used as a means for transmitting an output communication signal to a remote receiver, the signal being based on input to the bone conduction microphone 13. The input from the bone conduction microphone 13 is processed at the circuit board 14, and transmitted via the cable to a communication device for transmission to a remote receiver. However, a separate battery is provided on the second earpiece 5 to power the microphone 10 and bond conduction speaker 7.

Figure 4:
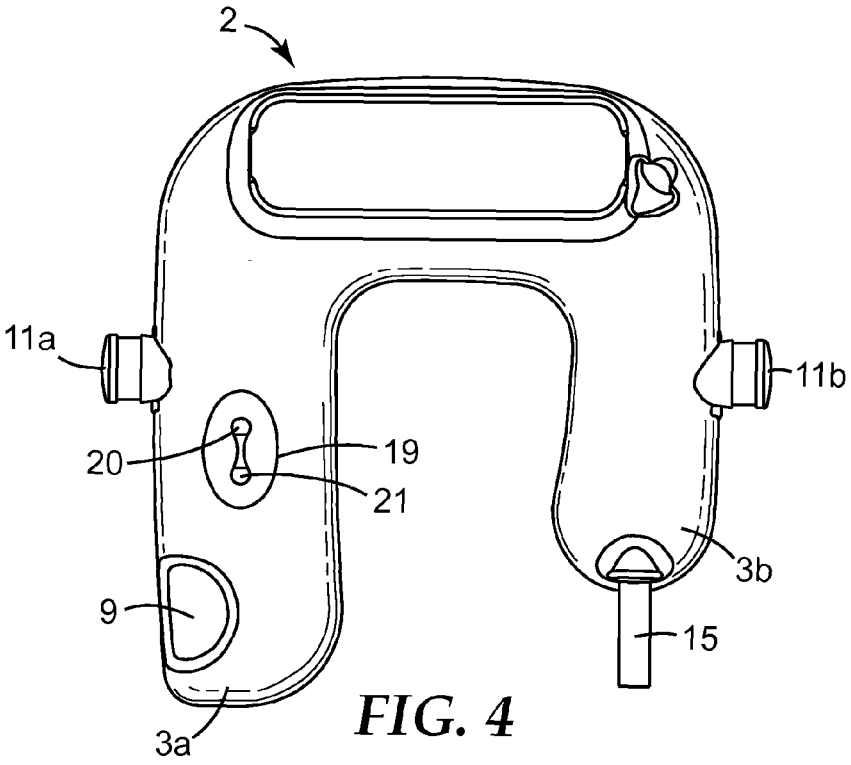
FIG. 4 is a side view of the outward facing surface of the earpiece shown in FIG. 3, showing the housing in place.

FIG. 4 is a side view of the outward facing surface of the earpiece shown in FIG. 3, showing the housing in place. Again, the earplug has been omitted from this figure for clarity. Both the base portion 17 and the housing 18 are made of ABS (acrylonitrile butadiene styrene) plastic, making them impact resistant as well as providing a smooth finish so as to be comfortable to wear. A set of control switches in the form of buttons 19 is provided on the housing on the first arm 3*a*. This set 19 comprises a first button 20 and a second button 21. Pressing and holding the first button 20 for a short period will turn the headset 1 on, and pressing and holding the second button 21 for a short period will turn the headset 1 off. Short presses on the first button 20 will increase the volume heard by a wearer, and short presses on the second button 21 will decrease the volume heard by a wearer.

An earplug 22 is used to provide the hearing protection function of the headset 1. This may be provided separately to the earpieces 2, 5, or may be mounted on the earpieces 2, 4 by means of a flexible connector. The connector may be formed from any suitable material, such as resilient plastics material, such that it is fully flexible, and unlikely to be tugged out of the ear when the head is moved. By avoiding covering the ears using conventional earcups the wearer feels more comfortable as the ears are cooler in hot and humid conditions. In addition, by providing an earplug merely to protect hearing, rather than with a speaker within the earplug, there is no need for additional wiring that may become tangled if the wearer is particularly active.

In use, the headset 1 functions as follows. Firstly, ambient sound is detected from a first direction. This corresponds to sounds from one side of a wearer being picked up by the first microphone 9. Secondly, ambient sound is detected from a second direction. This corresponds to sounds from the other side of a wearer being picked up by the second microphone 10. When these sounds have been processed, a signal based on the ambient sound from the first direction is relayed to the first bone conduction speaker positioned behind an ear of a wearer; and a signal based on the ambient sound from the second direction is relayed to the second bone conduction speaker 7 positioned behind the other ear of a wearer. Consequently the first bone conduction speaker 4 relays at least a signal based on the ambient sound from the first direction, and the second bone conduction speaker 7 relays at least a signal based on the ambient sound from the second direction. This creates an awareness of external surroundings for a wearer. If a communication signal is also transmitted to the wearer this is processed simultaneously with the signals based on the ambient sound and transmitted to the bone conduction speakers 4, 7. A function of "level dependence" is also provided. Level dependence is an amplification/attenuation process as described in the EN352-4 standard. In the present embodiment this is where the circuitry provided on the circuit board 14 provides either amplification or attenuation of the ambient sound detected by the by the first 9 and second 10 microphones, or of the signals. For example, signals having a volume of 50 dB or less will be amplified by 15 to 20 dB, typically. Signals having a volume between 50 and 80 dB will be amplified by 5 to 10 dB, typically. Signals having a volume of over 82 dB are attenuated to 82 dB. Furthermore it may be necessary to modulate the frequency range of any signals, and to reduce feedback.

In the embodiment described above, the communication between the wearer and a remote source is via the cable 15, positioned on the first earpiece 2. However, both communication means may be configured to receive signals from a remote source using a wireless communication means positioned on the first arm 3*a* of the second earpiece 2. The communication means may operate using one a number of protocols apart from radio frequency signals, such as Bluetooth™ technology. The power supply, a 1.2V or 1.5V "AAA" battery may be replaceable or rechargeable. If the battery is rechargeable, a socket for a charger plug is provided in the base 17 or housing 18 of the earpiece. If it is replaceable, a removable cover is provided in the housing 18 to give access to a battery compartment in which the battery is positioned. The earpiece described above is a two-piece ABS construction. Alternative constructions include unitary or multipiece (three or four-piece) constructions, in materials such as polypropylene (PP) or polyoxymethylene (POM). The earpieces 2, 5 are illustrated in FIGS. 1 to 4 as having the first arm 3*a*, 6*a* being longer than the second arm 3*b*, 6*b*. However, this is a matter of preference, and it may be equally preferred to have the second arm 3*b*, 6*b* longer than the first arm 3*a*, 6*a*, or for both the first 3*a*, 6*a* and second 3*b*, 6*b* arms to be substantially the same length.

What is claimed is:

1. A communication headset, comprising:

a first earpiece, having a first arm, positionable in front of a wearer's ear and a second arm, positionable behind a wearer's ear, with a first bone conduction speaker carried on the second arm;

a second earpiece, having a first arm, positionable in front of a wearer's ear and a second arm, positionable behind a wearer's other ear, with a second bone conduction speaker carried on the second arm, wherein the first and second arms of the first and second earpieces are linked to ether by a bridging portion carrying a power supply located at a first end of each of the first and second arms;

a first microphone, carried on the first earpiece, adapted to detect ambient sound from at least a first direction; and a second microphone, carried on the second earpiece, adapted to detect ambient sound from at least a second direction.

2. The headset of claim 1, wherein the first bone conduction speaker is configured to relay at least a signal based on the ambient sound from the first direction, and the second bone conduction speaker is configured to relay at least a signal based on the ambient sound from the second direction.

3. The headset of claim 1, further comprising a communication means adapted to receive an input communication signal from a remote source.

4. The headset of claim 3, wherein the first and second bone conduction speakers are adapted to relay the input communication signal to a wearer.

5. A communication headset, comprising:

a first earpiece, having a first arm, positionable in front of a wearer's ear and a second arm, positionable behind a wearer's ear, with a first bone conduction speaker carried on the second arm;

a second earpiece, having a first arm, positionable in front of a wearer's ear and a second arm, positionable behind a wearer's other ear, with a second bone conduction speaker carried on the second arm;

a first microphone, carried on the first earpiece, adapted to detect ambient sound from at least a first direction; and a second microphone, carried on the second earpiece, adapted to detect ambient sound from at least a second direction;

wherein at least one of the earpieces further comprises a bone-conduction microphone.

6. The headset of claim 5, comprising means for transmitting an output communication signal to a remote receiver, the signal being based on input to the bone conduction microphone.

7. A communication headset comprising:

a first earpiece, having a first arm, positionable in front of a wearer's ear and a second arm, positionable behind a wearer's ear, with a first bone conduction speaker carried on the second arm, the first earpiece further having a first housing covering the first earpiece;

a second earpiece, having a first arm, positionable in front of a wearer's ear and a second arm, positionable behind a wearer's other ear, with a second bone conduction speaker carried on the second arm, the second earpiece further having a second housing covering the second earpiece;

a first microphone, carried on the first earpiece, adapted to detect ambient sound from at least a first direction; and a second microphone, carried on the second earpiece, adapted to detect ambient sound from at least a second direction.

8. The headset of claim 7, wherein at least one control switch is provided on at least one of the housings.

9. The headset of claim 7, further comprising an earplug connected to each earpiece.

10. The headset of claim 7, wherein the first and second earpieces are joined together by a head band.

11. The headset of claim 10, wherein each earpiece further comprises at least one lug connectable with the headband, the headband being connected therebetween.

12. A method of relaying ambient sound to the wearer of a headset, comprising:

detecting ambient sound from a first direction with a first microphone carried on a first earpiece;

detecting ambient sound from a second direction with a second microphone carried on a second earpiece;

relaying a signal based on the ambient sound from the first direction to a first bone conduction speaker positioned behind an ear of a wearer; and relaying a signal based on the ambient sound from the second direction to a second bone conduction speaker positioned behind the other ear of a wearer, wherein at least one of the earpieces further comprises a bone-conduction microphone.

* * * * *

UNITED STATES PATENT AND TRADEMARK OFFICE

CERTIFICATE OF CORRECTION

PATENT NO. : 8,447,051 B2
APPLICATION NO. : 13/267109
DATED : May 21, 2013
INVENTOR(S) : Niklas Emilsson It is certified that error appears in the above-identified patent and that said Letters Patent is hereby corrected as shown below:

In the Claims

Column 7
Line 32, in Claim 1, delete "to ether" and insert -- together --

Signed and Sealed this
Twenty-seventh Day of August, 2013

Teresa Stanek Rea
*Acting Director of the United States Patent and Trademark Office*